US007757869B2

(12) United States Patent
Lawson

(10) Patent No.: US 7,757,869 B2
(45) Date of Patent: Jul. 20, 2010

(54) HANGER ADAPTABLE FOR USE WITH A SLATWALL TRACK AND A RETAINER THEREFOR

(76) Inventor: Stephen Lawson, 1947 Ocean Park Road, Surrey, B.C. (CA) V4A 3M2

( * ) Notice: Subject to any disclaimer, the term of this patent is extended or adjusted under 35 U.S.C. 154(b) by 387 days.

(21) Appl. No.: 12/005,089

(22) Filed: Dec. 26, 2007

(65) Prior Publication Data

US 2008/0105636 A1 May 8, 2008

(51) Int. Cl.
*A47F 5/08* (2006.01)

(52) U.S. Cl. ..... 211/94.01; 211/59.1; 248/225.21

(58) Field of Classification Search ..... 211/57.1, 211/59.1, 94.01, 54.1; 248/220.21, 222.52, 248/304, 339, 303, 308, 225.21
See application file for complete search history.

(56) References Cited

U.S. PATENT DOCUMENTS 3,045,961 A * 7/1962 Cygan ..... 248/222.12
4,303,217 A 12/1981 Garfinkle
4,615,448 A 10/1986 Johnstonbaugh
4,678,151 A * 7/1987 Radek ..... 248/223.41
4,852,838 A * 8/1989 Field ..... 248/222.13
6,050,426 A * 4/2000 Leurdijk ..... 211/94.01
6,119,878 A * 9/2000 Zen ..... 211/94.01
6,250,597 B1 * 6/2001 Kuo ..... 248/231.91
6,631,813 B1 10/2003 Walter et al.
6,749,161 B1 * 6/2004 Will et al. ..... 248/222.51
6,811,043 B2 * 11/2004 Perkins et al. ..... 211/94.01
6,971,614 B2 * 12/2005 Fischer et al. ..... 248/220.43
7,175,149 B2 2/2007 Gallien
7,427,053 B2 * 9/2008 Nawrocki ..... 248/220.21

* cited by examiner

*Primary Examiner*—Darnell M Jayne
*Assistant Examiner*—Stanton L Krycinski
(74) *Attorney, Agent, or Firm*—Frederick Kaufman, Inc.

(57) ABSTRACT

A flexible deformable retainer has top and bottom horizontal walls and lateral vertical walls, the latter being perpendicular to a slatwall track, respectively to top and bottom horizontal walls of the latter. Top and bottom horizontal walls have edges abutting a central flat body of a hanger's bracket and each outward edge has a removal cutoff. Lateral vertical walls are used for insertion into vertical slits provided in a hanger's bracket. Each lateral vertical wall includes a curvature configured for snapping into a vertical slit. The retainer is able when the hanger is bumped vertically, to engage, via upper edges of its lateral vertical walls, a horizontal top of an intermediate channel of the slatwall track. A gap is provided between a horizontal top of the latter and the upper edges of retainer's lateral vertical walls.

1 Claim, 4 Drawing Sheets

Section A-A

HANGER ADAPTABLE FOR USE WITH A SLATWALL TRACK AND A RETAINER THEREFOR

I. BACKGROUND OF THE INVENTION

1. Definition of the Invention

The present invention refers, in general, to features for preventing the dislodging of hangers attached to slatwall tracks and, more particularly, to a hanger adaptable for use with a slatwall track and a retainer therefor.

2. Description of the State of Art

The walls of a building in residential, commercial and industrial buildings are frequently provided with one or more slatwall tracks used in combination with hangers to display a variety of objects off the floor of the building. The objects can be similar, such as in a display for merchandise in retail stores, for example shoes, or they can vary in shape, size, weight and type, such as in a garage or workshop, etc. to suspend, for example, gardening or other hand tools. The hangers can also be used to support shelves for storing or displaying various items. The slatwall tracks are made of metal, metal alloys or plastic and formed by an extrusion. Slatwall tracks are generally secured to a building structure, which includes without limitation any walls, such as temporary or permanent walls. The walls may or may not be covered with wallboard. The slatwall tracks are attached with screws directly to walls having physical strength, to an existing frame or studs normally used to hold the wallboard.

Often a slatwall track is interlockingly connected with an identical upper and/or lower slatwall track(s). Also, two or more usually like-shaped slatwall tracks are mounted vertically spaced and horizontally aligned and parallel. A single slatwall track, mounted alone, is also used. Usually, several hangers or other supporting devices are attached A main disadvantage of hangers secured to slatwall tracks resides in the fact that the attachment of the former to the latter is unreliable. Hangers can be dislodged following an unintentionally caused vertical push that forces the hangers' brackets to move vertically until they cease their engagement with slatwall tracks and, then, turn around and fall to the ground. The people around can be injured and the hung items can be damaged. When loaded hangers are positionally displaced, dislodging can easily occur.

Attempts have been made to solve the dislodging problem. For example, U.S. Pat. No. 6,971,614 granted on Dec. 6, 2005 to Fischer et al. for a "SLATWALL HANGER STABILIZING CLIP" discloses a slatwall assembly including several interlocked tracks. Each of the tracks has an upper and lower end provided with a lip with an inside surface, so that adjacent tracks form a channel with a narrow outer portion and a wider inner portion. A hanger comprises an upper end that is inserted into an upper channel, and a lower end that hangs near a lower adjacent channel. A stabilizing clip has a main body and an extending brace. The body is sized and shaped to firmly snap fit into the lower channel. The brace extends upwardly along a middle track to form a channel for receiving the lower end of the hanger and retaining it against the surface of a middle track. The main shortcoming of the foregoing stabilizing clip resides in the fact that it does not prevent completely an upward inadvertently caused movement of the hanger, although it retains the lower end of the hanger against pivoting around the upper end.

II. SUMMARY OF THE INVENTION

There is a need for an improved retainer adaptable to be used together with a hanger for a secure attaching to a slatwall track.

Thus, the main objective of the present invention is to improve the overall performance of a slatwall track when used in conjunction with one or more hangers.

A specific objective of the present invention is to develop a retainer that can be easily inserted into and removed from a hanger, so that rearrangement of the hangers is simple and does not require any tool.

Broadly stating, the present invention uses a flexible deformable retainer having top and bottom horizontal walls and lateral vertical walls, the latter being perpendicular to a slatwall track, respectively to top and bottom horizontal walls of the latter. Top and bottom horizontal walls have edges abutting a central flat body of a hanger' bracket and each outward edge has a removal cutoff. Lateral vertical walls are used for insertion into vertical slits provided in a hanger' bracket. Each lateral vertical wall includes a curvature configured for snapping into a vertical slit. The retainer is able when the hanger is bumped vertically, to engage, via upper edges of its lateral vertical walls, a horizontal top of an intermediate channel of the slatwall track. A gap is provided between a horizontal top of the latter and the upper edges of retainer's lateral vertical walls.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

IV. DESCRIPTION OF A PREFERRED EMBODIMENT

Figure 1:
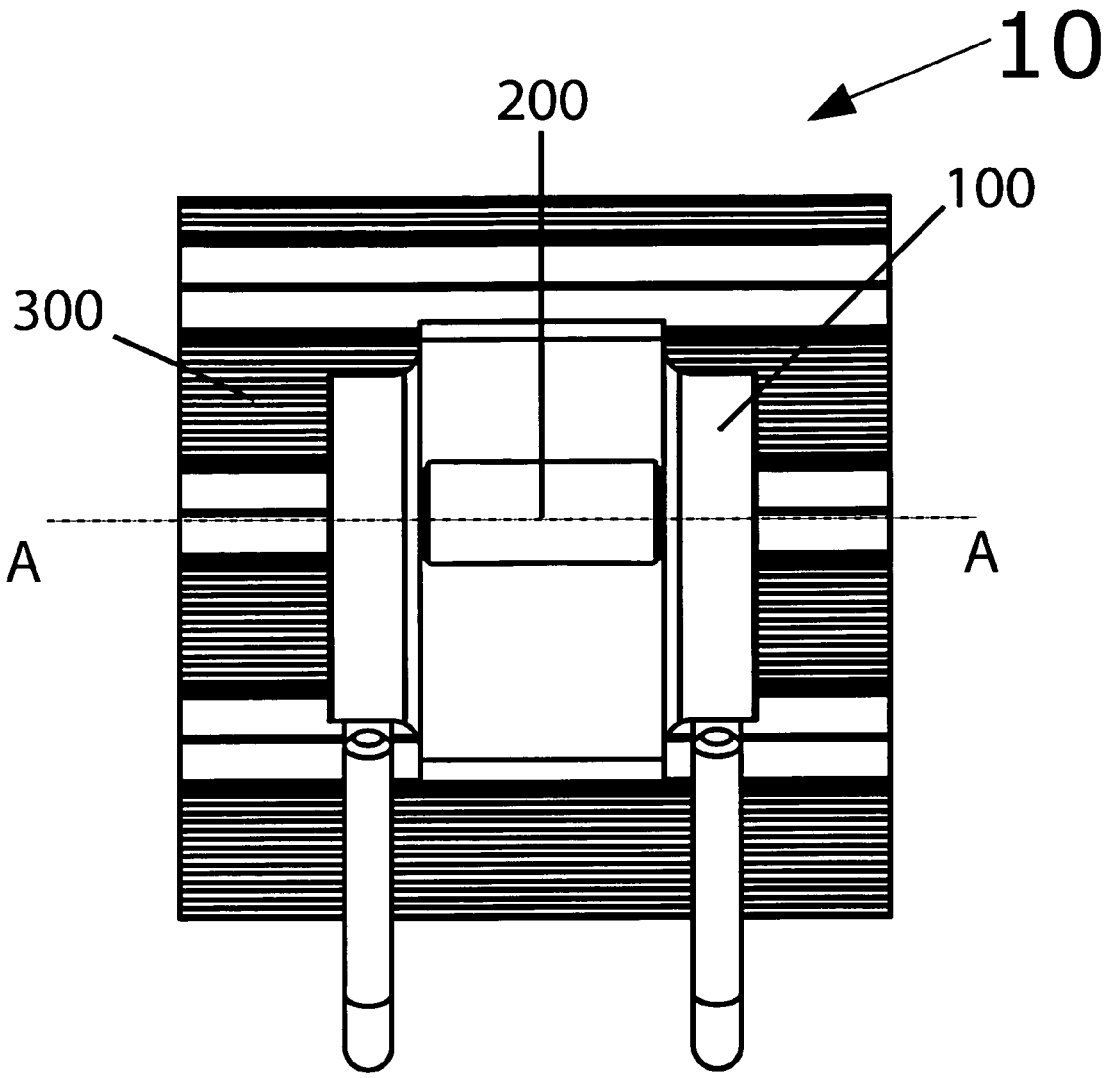
FIG. 1 is a frontal elevation view of the present invention, showing a hanger stabilized by a retainer into a slatwall track.
Figure 2:
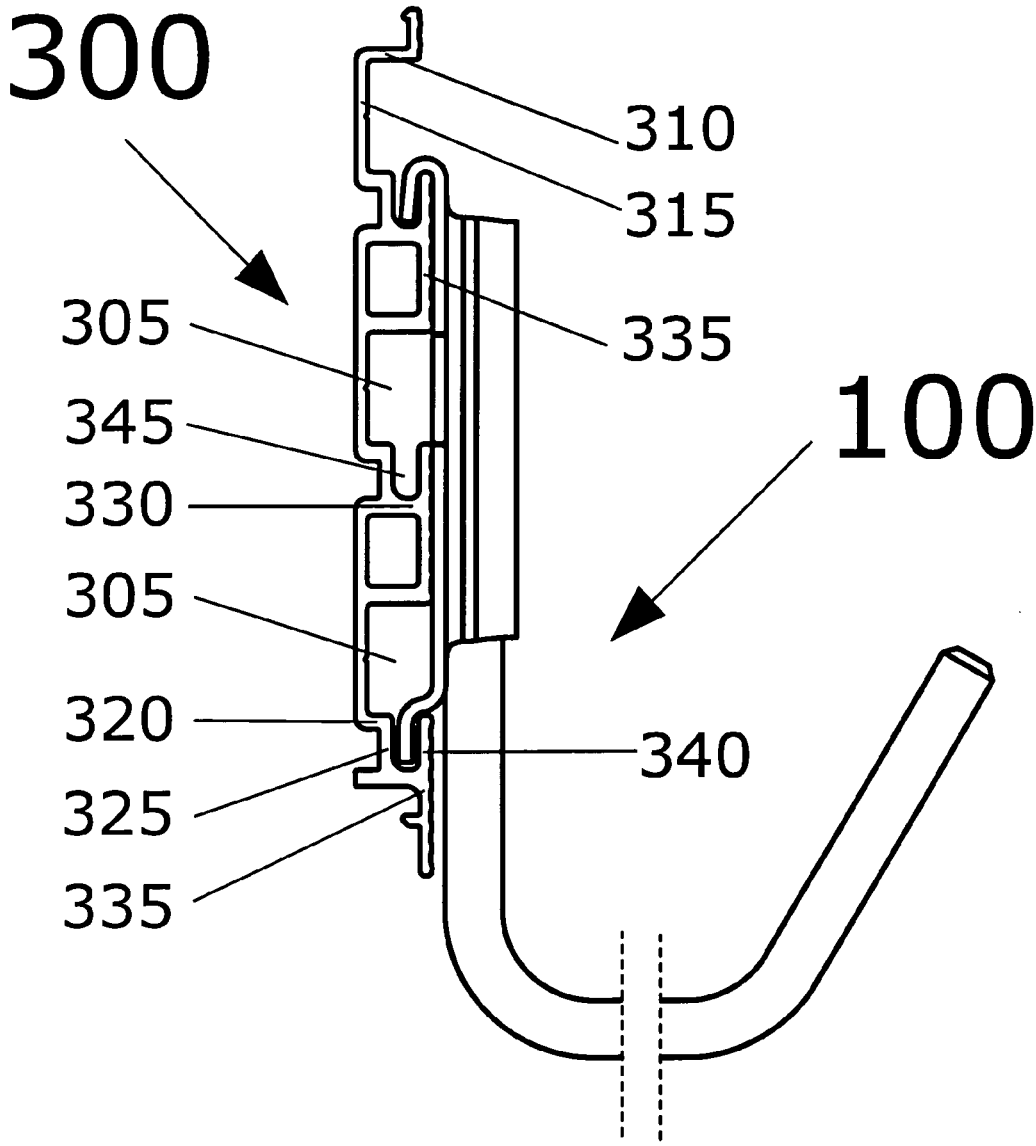
FIG. 2 is a side elevation view of FIG. 1, without the retainer.
Figure 3:
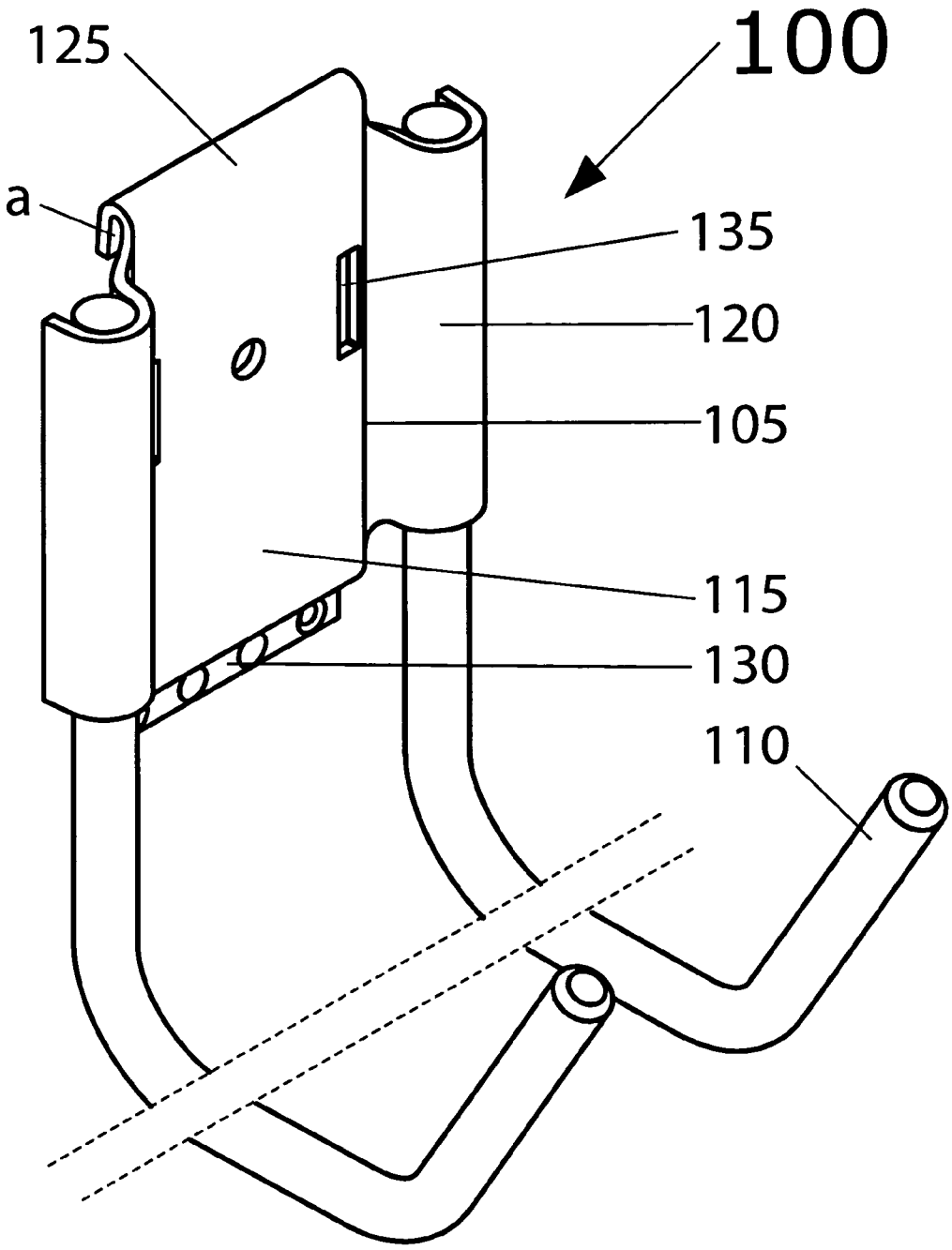
FIG. 3 shows a perspective view of the hanger.
Figure 4:
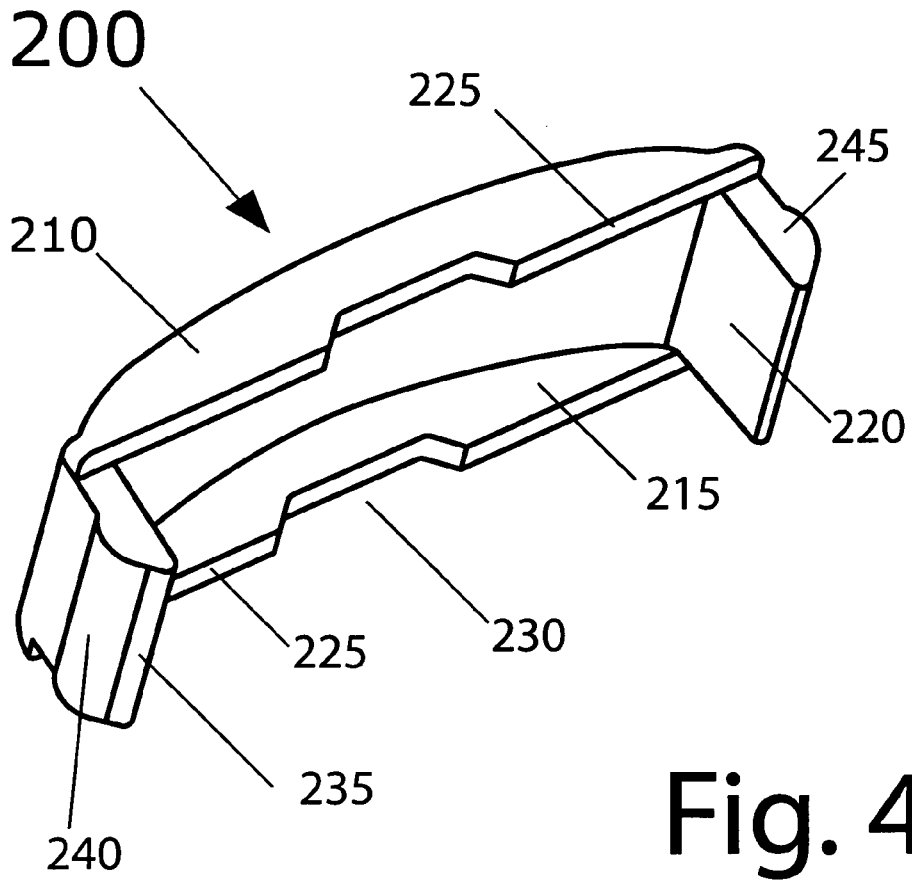
FIG. 4 shows a perspective view of the retainer.
Figure 5:
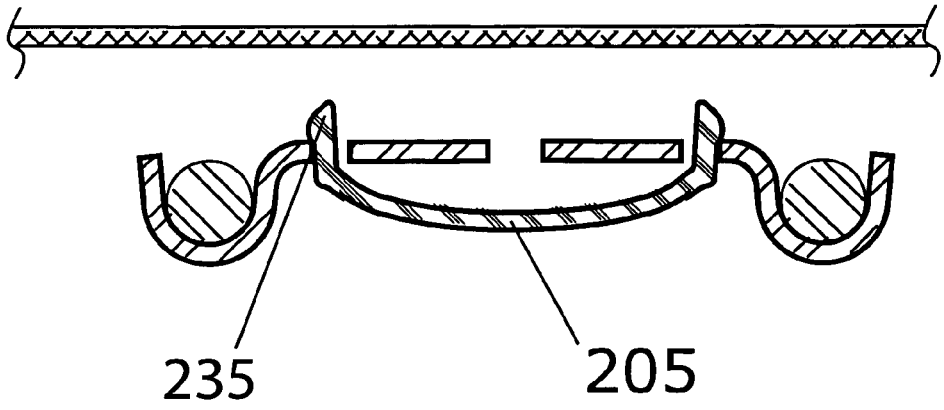
FIG. 5 is cross-section, along line A-A, of FIG. 1.

FIGS. 1 to 5 illustrate an embodiment of the present invention, generally designated with numeral 10, which comprises, in combination, a hanger 100 and a retainer 200 that interact and are adapted to be attached to a slatwall track 300.

Slatwall track 300 incorporates several channels 305 extending in parallel along its length. Each of the latter, starting from the top, has a horizontal top 310, followed downwardly by an upper vertical back 315, a first horizontal bottom 320 extending forwardly, a lower vertical back 325 extending downwardly, and a second horizontal bottom 330 extending forwardly. A frontal vertical wall 335 of slatwall track 300 connects each horizontal top 310 of a lower channel 305 with second horizontal bottom 330 of an upper following channel 305 and continues upwardly as a lip 340. The latter has, in general, a height limited by a plane (not shown) coplanar with an upper surface of first horizontal bottom 320.

Thus, in each channel 305 a niche 345 is formed by lower vertical back 325, lower second horizontal bottom 330 and lip 340.

Although slatwall track 300 is shown and described to have several channels, each of them having a lower lip 340 and a niche 345, it should be understood that other slatwall tracks with differently shaped channels could be used without departing from the broad concept of this invention.

One or more hangers 100 are adapted for use with a slatwall track 300. Usually, each hanger 100 is removably attached to slatwall track 300. Hanger 100 includes a bracket 105 for attaching to slatwall track 300 and two hooks 110 permanently secured to bracket 105 and used for suspending different items.

Bracket 105 has a central flat body 115 that ends laterally on each side with a forwardly protruding rounded portion 120 for lodging and permanently securing a hook 110, an uppermost backwardly folded segment 125 that forms an interstice a adapted to engage and capture partially, in a vertical direction, lip 340 of a channel 305, an upper one, and into a lowermost flat retracted segment 130 that forms a backwardly directed step for engaging a lip 340 of another channel 305, a lower one, namely an inside surface of lip 340. Between upper and lower channels 305, there is another channel 305, an intermediate one, via which bracket 105 throughout retainer 200 (further described this disclosure) interconnects with slatwall wall 100. Central flat body 115 of bracket 105 is provided at each extremity, before forwardly protruding rounded portion 120, with a vertical slit 135. Basically, the latter has a length generally coextensive with a channel 305, respectively with the intermediate one, which sizewise is identical with upper and lower channels 305, and, more specifically, with a distance usually less than a distance between horizontal top 310 and lip 340 (respectively an upper edge of the latter). Uppermost folded segment 125 and lowermost flat retracted segment 130 have their vertical dimensions, i.e. their heights, relatively less than a vertical dimension, i.e. a height of lip 340. Thus, a complete engagement of bracket 105 with two vertically spaced lips 340 can be achieved.

Based on the foregoing description, one can infer, that, in general, with respect to a slatwall track 300, a hanger 100 is able to keep its vertical position and be horizontally translated. But in use, when a hanger 100 is unintentionally hit or pushed in a vertical direction, it can easily occur that uppermost, backwardly folded segment 125 ceases to engage and, thus, capture a lip 340 of a channel 305, respectively an upper one; simultaneously lowermost flat retracted segment 130 exits from niche 345 of another channel 305, respectively a lower one, thereby ceasing the engagement with lip 340 of this channel 305. In this situation, hanger 100, loaded or not, but even more when loaded, will somewhat rotate with respect to frontal vertical wall 335 of slatwall track 300 and fall.

Although hanger 100 is illustrated and described to have a particular structure, it should be understood that other hangers or supporting devices with different structures could be used with described slat wall 300 or other slatwall tracks without departing from the basic concept of this invention.

Retainer 200 has a unitary, relatively elongated body, which incorporates a frontal curvilinear wall 205 extending into a top and bottom horizontal walls 210 and 215, respectively, and into a pair of lateral vertical walls 220, perpendicularly disposed with respect to top and bottom horizontal walls 210 and 215. Frontal curvilinear wall 205 has, essentially, as seen from the top, a shape bounded by a circular circumference portion, while top and bottom horizontal walls 210 and 215—each has the shape of a circular sector. Top and bottom horizontal walls 210 and 215 are each provided with an outward edge 225 that abuts central flat body 115 of bracket 105. Each outward edges 225 is discontinued centrally by a narrow, relatively shortly extended cutoff 230, intended to facilitate removal of retainer 200 from its set position.

A distance between the pair of lateral vertical walls 220 and a distance between vertical slits 130 are basically comparable. Each lateral vertical wall 220 commences with a narrow zone 235, angled towards the exterior, which continuously widens and eventually expands into an offset zone 240. Narrow zone 235 basically starts with a width substantially commensurable with a width of a vertical slit 130. Offset zone 240 has a width slightly larger than the width of vertical slit 130, but due to its capacity to flexibly deform is able to return to its normal size after traversing vertical slit 130 and, whereby, escape and be retained against a surface of central flat body 115 of bracket 105 that faces a channel 305, namely, an intermediate channel 305. Thus, a secure snap is realized.

Retainer 200, via its pair of lateral vertical walls 220, inserted through vertical slits 135 provided in bracket 105, is secured to the latter by snapping. Moreover, when hanger 100 is unintentionally bumped vertically, retainer 200 is so dimensioned that is able to engage, via upper edges 245 of its pair of lateral vertical walls 220, horizontal top 310 of an intermediate channel 305. There is a small dimensional gap between horizontal top 310 and upper edges 245 of its pair of lateral vertical walls 220. That gap allows the use of substantially large manufacturing tolerances for both retainer 200 and slatwall track 300, while assuring a reliable engagement that prevents the dislodging to occur.

What I claim is:

1. A hanging assembly comprising, in combination, a hanger interconnected with a slatwall track and a retainer to secure said hanger to said slatwall track, said slatwall track including several parallel channels extending along its length, each of said several parallel channels incorporating a horizontal top, successively followed downwardly by an upper vertical back, a first horizontal bottom extending forwardly, a lower vertical back extending downwardly and a second horizontal bottom extending forwardly, and then a frontal vertical wall of said slatwall track connecting said horizontal top of a following lower channel with said second horizontal bottom of an upper following channel and continuing upwardly as a lip, a niche being formed by said lower vertical back, said lower second horizontal bottom and said lip, said hanger including a bracket having a central substantially flat body provided laterally at each side with a hook, and extending into an uppermost backwardly folded segment adapted to engage and capture partially, in a vertical direction, said lip of an upper channel, and extending into a lowermost flat retracted segment that forms a backwardly directed step for engaging an inside surface of said lip between said upper and said lower channels, an intermediate channel identical to said upper and said lower channels being used, said intermediate channel providing a space wherein said retainer after penetrating said bracket is partially extending for interconnecting with said slatwall wall; said central flat body being also provided at each extremity, before said hook, with a vertical slit having a length generally coextensive with said intermediate channel, said length being relatively slightly less than a length between said horizontal top and an upper edge of said lip;

said retainer being provided with a capacity to flexible deform and having an elongated body extending into a top and bottom horizontal walls and into a pair of lateral vertical walls, perpendicularly disposed with respect to said top and bottom horizontal walls, each of said top and bottom horizontal walls being provided with an outward edge abutting said central flat body, said outward edge being discontinued centrally by a narrow, relatively shortly extended cutoff intended to facilitate removal of said retainer from its set position; a distance between said pair of lateral vertical walls and a distance between said vertical slits being approximately the same, each said lateral vertical wall being provided with means for snapping into said vertical slits, wherein said retainer is so dimensioned that it is able, when said hanger is unintentionally bumped vertically, to engage, via upper edges of said pair of lateral vertical walls, said horizontal top of said intermediate channel, therefore a small dimensional gap between said horizontal top and said upper edges is provided.

* * * * *